United States Patent [19]

Sinkó

[11] Patent Number: 4,694,933

[45] Date of Patent: Sep. 22, 1987

[54] SELF-PROPELLED SCAFFOLD FOR BUILDINGS AND ROPE TENSIONING MEANS, AS WELL AS PROCESS FOR THE CONSTRUCTION AND/OR FOR THE SERVICING OF HIGH BUILDINGS

[75] Inventor: Tibor Sinkó, Budapest, Hungary

[73] Assignee: Kisuzemi Innovacios Iroda, Budapest, Hungary

[21] Appl. No.: 690,499

[22] PCT Filed: Apr. 19, 1984

[86] PCT No.: PCT/HU84/00027

§ 371 Date: Dec. 18, 1984

§ 102(e) Date: Dec. 18, 1984

[87] PCT Pub. No.: WO84/04127

PCT Pub. Date: Oct. 25, 1984

[30] Foreign Application Priority Data

Apr. 19, 1983 [HU] Hungary ..... 1343/83
Apr. 19, 1983 [HU] Hungary ..... 1344/83

[51] Int. Cl.[4] ..... E04G 3/10
[52] U.S. Cl. ..... 182/128; 182/142
[58] Field of Search ..... 182/128, 187, 133, 136, 182/150, 142; 249/20–27

[56] References Cited

U.S. PATENT DOCUMENTS

| | | | |
|---|---|---|---|
| 350,289 | 10/1886 | Brown | 182/187 |
| 351,143 | 10/1886 | Wittingham | 182/187 |
| 2,906,365 | 9/1959 | Howard | 182/136 |
| 4,060,358 | 11/1977 | Fougea | 182/128 |

FOREIGN PATENT DOCUMENTS

| | | | |
|---|---|---|---|
| 20455 | 6/1905 | Austria | 182/187 |
| 465292 | 4/1926 | Fed. Rep. of Germany | 182/187 |
| 2163110 | 7/1973 | Fed. Rep. of Germany . | |
| 2930906 | 2/1980 | Fed. Rep. of Germany . | |
| 634602 | 2/1962 | Italy | 182/128 |
| 530094 | 11/1976 | U.S.S.R. | 182/128 |
| 754023 | 8/1980 | U.S.S.R. . | |
| 775272 | 11/1980 | U.S.S.R. | 182/187 |

*Primary Examiner*—Reinaldo P. Machado
*Assistant Examiner*—Alvin Chin-Shue
*Attorney, Agent, or Firm*—Young & Thompson

[57] ABSTRACT

Self-propelled scaffold for buildings (1) exhibiting a continuously closed contour, wherein the scaffold comprises a framework and a working platform arranged on a horizontal bracket (2) of the framework; as well as a rope tensioner (15) for the scaffold with two clamping units (101, 102) that can be moved with respect to each other and are opened and closed in phase opposition. The scaffolding is associated with at least two sets of jaws (7), respectively connected, with a mutually independent, detachable connection, to an outside face (4) of the building (1), one jaw set (7) being fixedly attached to the scaffolding and the further jaw sets (7) being connected, respectively by a length-variable element, with the first jaw set (7) or with one another. The rope tensioner (15 ) of this invention is fashioned as a compact unit operated by a pressure medium, both clamping units (101, 102) and a working cylinder (103) moving the units with respect to each other being housed in this compact unit, each clamping unit (101, 102) comprising at least one clamping device (104) and at least one working cylinder (105, 106; 142) connected therewith.

17 Claims, 10 Drawing Figures

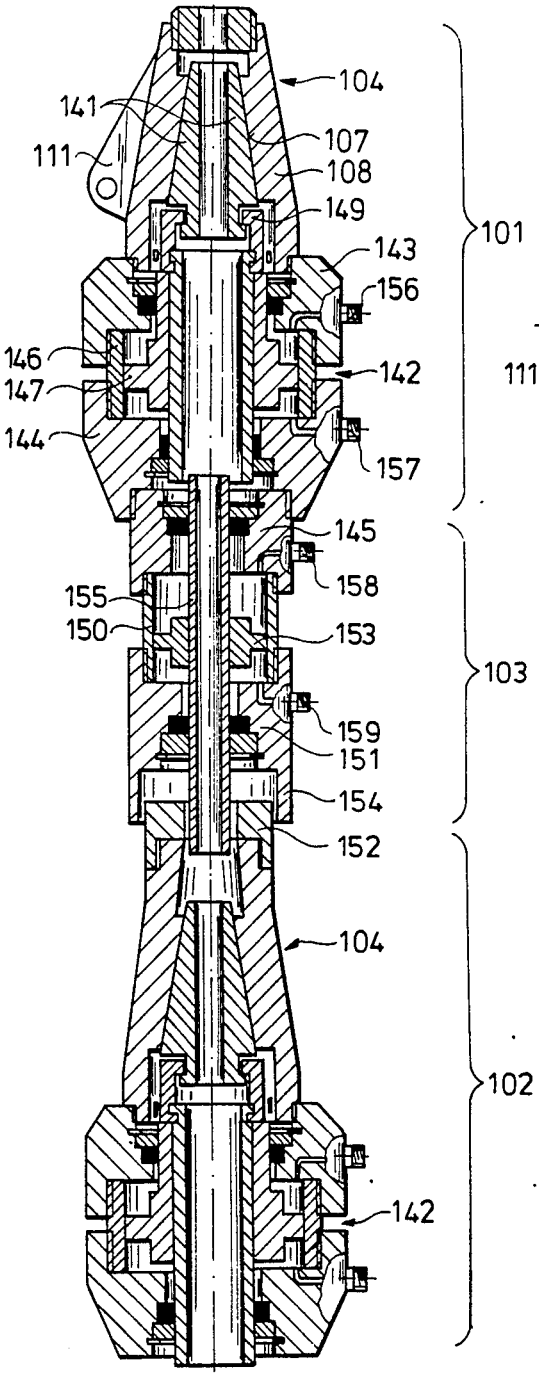
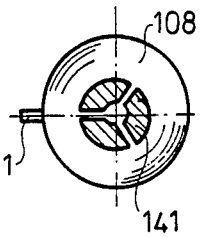
Fig. 10
Fig. 9

SELF-PROPELLED SCAFFOLD FOR BUILDINGS AND ROPE TENSIONING MEANS, AS WELL AS PROCESS FOR THE CONSTRUCTION AND/OR FOR THE SERVICING OF HIGH BUILDINGS

OBJECT OF THE INVENTION

The invention concerns a self-propelled scaffold for buildings exhibiting a continuous outline, this scaffold comprising a scaffolding and a working platform arranged at a horizontal bracket of the scaffolding. The invention furthermore relates to a rope winch with two clamping units that can be moved with respect to each other and are opened and closed in phase opposition; this rope winch can be used with advantage, for example, in the self-propelled scaffold of this invention. Finally, the invention relates to a process for the construction and/or servicing of high buildings, the realization of which is particularly facilitated by the scaffold and rope winch according to this invention.

STATE OF THE ART

The scaffold required for work to be performed on high buildings has posed an unsolved problem for a long time. Thus far, a large number of movable scaffolds, operating on the basis of a great variety of principles, has become known pertaining to one of the following two groups:

So-called suspended scaffolds are widely utilized wherein the scaffolds are attached to a stable suspension point, for example to a roof or a bracket. These suspension points must, of course, be at a higher level than the plane of the work being performed. These conventional devices thus not only exhibit the disadvantage that a load-bearing suspension point, a roof construction or a bracket, must be present, but also that the work operation can be executed only along a vertical strip along the building, and the devices proper are labile, unstable, and of low load-bearing capacity. A good example in this connection is disclosed in Austrian Pat. No. 330,437 wherein a working basket is suspended on the upper rim of a water tower.

The other group of movable scaffolds includes the so-called supported scaffolds transmitting their load to a steel construction independent of the building to be worked on. However, this feature is a cause for many deficiencies. The working platform is rigid; it does not follow the shape of the building, either in the vertical or horizontal direction. A supported scaffold is described in Russian Pat. No. 918,407.

The provision of a working platform all around the periphery of the building is impossible with the movable scaffolds known heretofore. Thus, the working operations with their aid, the repair work, servicing work, or any assemblies can only be carried out in vertical strips, in stages. It is not possible, either, to circumvent the building. The conventional solutions are furthermore also burdened by static disadvantages, making it necessary to over-dimension the structure to overcome such disadvantages.

As will be described in greater detail below, a rope winch is likewise required for solving the problem according to this invention in connection with the scaffold. Such utilization alone absolutely necessitates a further development of the conventional rope winches, as will be explained hereinbelow.

In most cases, block and tackle systems, powered manually or by a motor, are used for the tensioning of ropes, the rope being wound up on a cylindrical drum. A long threaded bolt is likewise known, connected to two helical spindles with oppositely oriented pitches, the two ends of the rope to be tensioned being joined to the helical spindles. These solutions can be utilized only in the simplest cases.

A greater tensile force can be exerted by a construction, likewise conventional, wherein respectively one series of rollers is arranged on two axles, and the rope is guided over the rollers alternatingly on one and the other axle. Tensioning of the rope is effected by moving the two axles away from each other, for example with the aid of hydraulic operating cylinders, after tightening the rope. This construction is not only relatively complicated and heavy, but the velocity of the rope also increases with an increasing number of rollers since the latter are so-called multiplier rollers.

In all of the rope winches known heretofore, tensioning is possible only along a limited length. Once these devices have reached the end of their stroke length, the rope cannot be tensioned any further with their aid.

In order to overcome this drawback, it has been suggested to utilize in the rope winch two clamping units that can be moved with respect to each other and are opened and closed in phase opposition. In this arrangement, two clamping jaws are arranged in opposed relationship on both sides of the rope and are moved along an eccentric path with respect to each other during opening and closing, respectively, by means of an eccentric mechanism. The two clamping units are joined by a linkage which also drives the eccentric mechanism. This makes it possible that, simultaneously with the operation of the eccentric mechanism, also the two clamping units are moved with respect to each other. In this way, the rope winch is moved along the rope, taking one rope end with it and thus tensioning the rope.

It was found under practical conditions that this construction bears only very limited loads and is unsafe in operation. The eccentric mechanism and the linkage are sensitive and trouble-prone machine elements. The force required for a slip-free closing of the rope winch must be provided by the compressive force exerted on the rope by the clamping jaws, this force being transmitted by the eccentric mechanism from the linkage. However, slipping of the clamping units occurs frequently in this arrangement.

BASIC ASPECT OF THE INVENTION

The invention is based on the object of providing a self-propelled scaffold for buildings with a continuous contour which requires no suspension structure, cover structure, or bracket, no supporting frame, and with the aid of which the building can be circumvented along its entire periphery, this scaffold moving along the building in a self-propelled fashion. The scaffold must also satisfy the load and safety regulations.

According to the further development of this invention, this object has been attained by associating with the scaffolding at least two jaws, each attached to an outside face of the building with a detachable connection, one being independent of the other, wherein one jaw is fixedly mounted to the scaffolding and the other jaws are connected to the first jaw and/or to one another respectively by a length-variable element.

Such scaffolds according to the invention have been particularly successful wherein two jaws are associated with a beam of the scaffolding in parallel with the outside face of the building, one jaw being attached to the beam and the other being mounted to be displaceable thereat, the two jaws being connected to the length-variable element.

It proved furthermore to be advantageous to produce the detachable connection between the jaws and the outside face of the building by friction, the normal force required for friction being provided by an element that is guided around the building, can be variably tensioned, and presses the jaws against the outside face.

It is also advantageous according to the invention for each jaw to be provided with a sleeve accommodating the beam of the scaffolding, a forced track guiding the tensioning element therethrough, and a traction surface in contact with the outside face of the building.

The forced track can be arranged to be inclined with respect to the traction surface, the upper end of the forced track which is closer to the upper portion of the building being farther removed from the traction surface than the lower end.

As usual in modern technology, the length-variable element can be fashioned advantageously as a pneumatic or hydraulic operating cylinder.

During movement of the scaffold, it is advantageous according to the invention to associate at least two rollers with the beam in parallel to the outside face of the building.

With a view toward the safety of the scaffold, it is advantageous to provide same with a fall-preventing equipment, comprising safety jaws pressed against the outside face of the building by at least two mutually independent tensioning elements. Each safety jaw can include a forced track, to be passed through by the tensioning element, and a traction surface in contact with the outside face of the building. It is furthermore advantageous to arrange the forced track to be inclined with respect to the traction surface, the upper end of the forced track closer to the top portion of the building being closer to the traction surface than the upper end.

If an inner working platform is also desired, then the provision can be made according to this invention to connect a jib of a crane structure to the beam of the scaffolding in parallel with the outside face, and to suspend by means of the crane structure an inner working platform in the interior of the building. In this connection, it proved to be advantageous to provide the inner working platform with a scaffolding and the latter with flooring, vibration-damping beams, and safety means against falling, these safety means being connected hingedly with the scaffolding and being connected to an inside face of the building by jaws respectively equipped with a traction surface. The crane structure can also service the inner working platform.

The tensioning element can be a chain in accordance with this invention. However, it proved to be more advantageous for the tensioning element to be a rope, preferably a wire cable.

In order to provide the normal frictional force, one embodiment comprises the feature that the variably tensionable tensioning element is associated with at least one winch connected thereto. The winch can be a hydraulic or pneumatic cable winder.

As mentioned above, the conventional rope winches are burdened by a number of disadvantages. The objects to be attained by this invention can, however, be completely achieved by means of a further developed rope winch wherein the latter is designed as a compact unit operated with a pressure medium; the unit contains in its interior the two clamping units and a working cylinder moving these units with respect to each other, each of the clamping units being equipped with at least one clamping device and at least one working cylinder connected to the clamping device. The pressure medium can be hydraulic fluid or compressed air. It can furthermore be advantageous to connect piston rods of the working cylinders of the clamping units to the clamping device, wherein the piston rods, as well as a piston rod of the working cylinder moving the clamping units with respect to each other, are fashioned as tubular cable guide means. The simplest arrangement resides in providing the clamping device with clamping members guided along a conical surface.

In some cases of practical application, it proved to be advantageous for the clamping members to be designed as disks, each of which is provided with a circumference adapted to the conical surface and with a bore, the diameter of which is larger than the cross section of the rope, the bores of each second disk in the clamping device being arranged concentrically to the longitudinal axis of the rope winch, and the bores of the other disks being arranged with the same eccentricity with respect to the longitudinal axis. In this arrangement, respectively one operating cylinder can be disposed on both sides of the clamping device.

In another advantageous embodiment, the clamping members are fashioned as clamping jaws in the manner of a collet at a 120° interval, these jaws being also guided on the conical surface to prevent rotation. In this connection, it may suffice to associate only one working cylinder with the clamping device, the piston rod of which is connected to the clamping jaws of the clamping device in a way transmitting compressive force as well as tensile force.

As mentioned in the introduction, construction and/or servicing operations heretofore had to be performed in vertical strips, in stages, which is disadvantageous in regard to not only the economy, but also the quality of the work and the safety of the construction and servicing operations.

These deficiencies are entirely eliminated by the process as further developed by this invention, wherein the construction and/or servicing operations are effected on the inside and/or outside of the building at a given working level simultaneously all around the building, the progression of steps being, in correspondence with the respective technique of construction and/or servicing, upwards or downwards, optionally by sections upwards and downwards.

BRIEF DESCRIPTION OF THE DRAWINGS

Additional details of the invention will be described in greater detail below, based on embodiments, with reference to the appended drawings wherein:

FIG. 9 shows another embodiment of the rope winch, likewise in a sectional view, and FIG. 10 is a cross-sectional view through an upper portion of FIG. 9.

PREFERRED EMBODIMENT OF THE INVENTION

Figure 1:
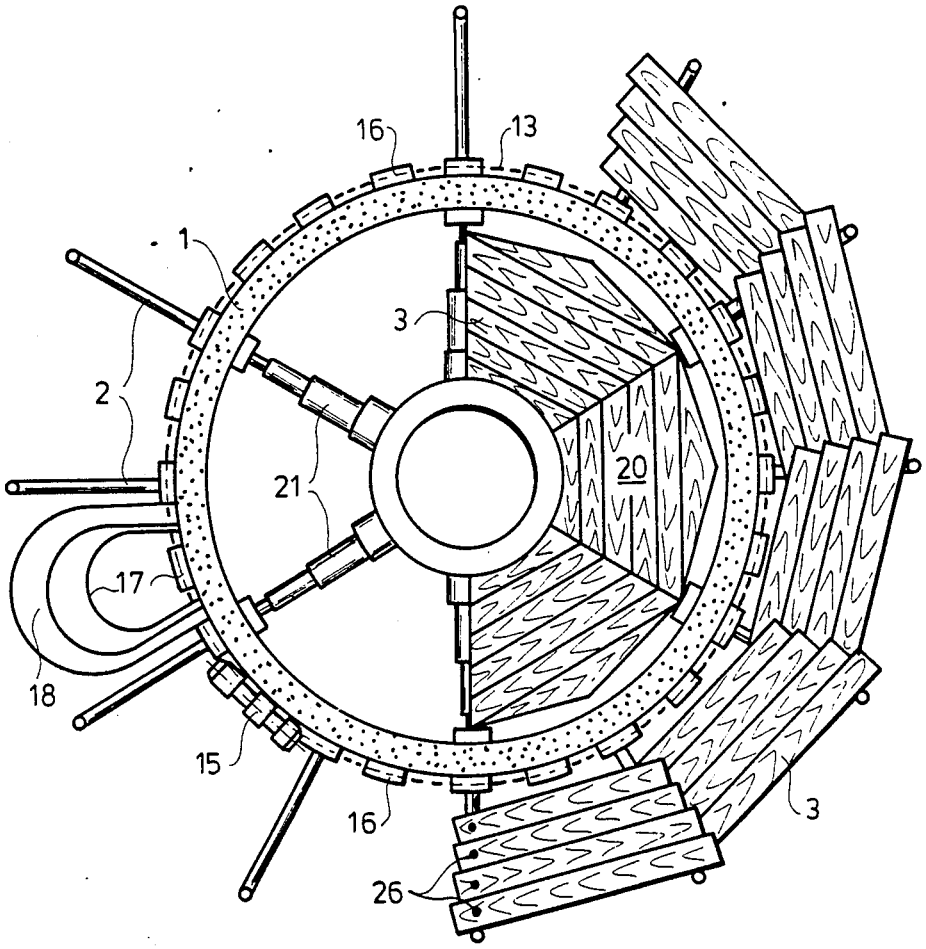
FIG. 1 shows a schematic top view of one embodiment of the self-propelled scaffold according to this invention.

As can be seen from the schematic top view of FIG. 1, this embodiment of the self-propelled scaffold according to the invention is arranged around a closed-contoured building 1, around a smokestack, water tower, or the like. The material of the building 1 can be monolithic concrete, masonry, or similar material. In this arrangement, the scaffold has a triangular framework, a flooring 3 serving as the working platform being arranged on the horizontal bracket 2 thereof. The entire scaffolding with the bracket 2 is connected—in a way to be described below—with a detachable connection to an outside face 4 of the building 1.

Figure 2:
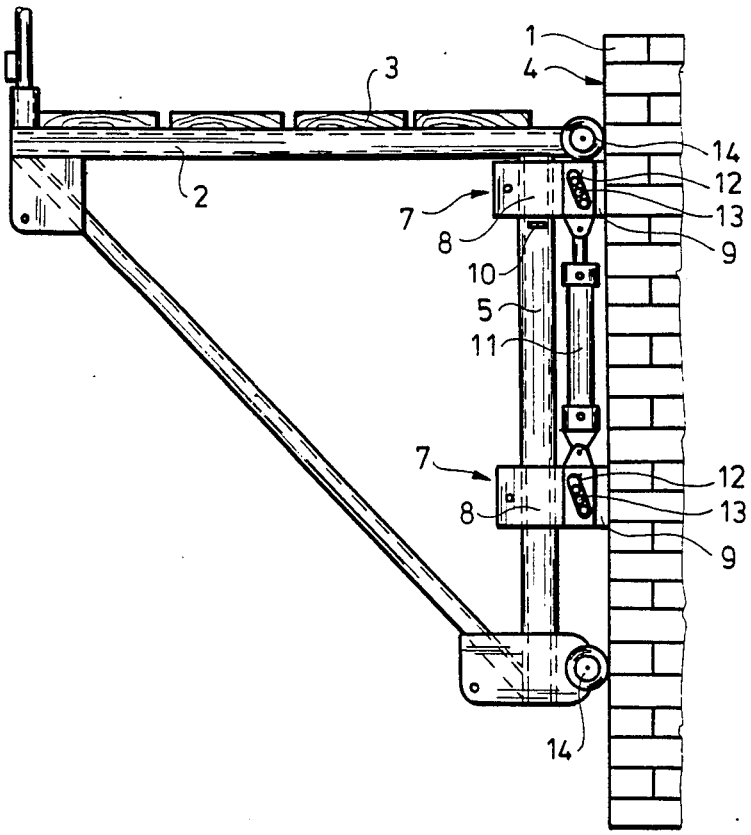
FIG. 2 shows a lateral view, partially in section, of the embodiment of FIG. 1.

The lateral view in FIG. 2 clearly shows the triangular framework and the horizontal bracket 2, as well as the flooring 3. The scaffolding furthermore comprises a beam 5 in parallel to the outside face 4 of the building 1, as well as a bracket 6 connecting the bracket 2 and the beam 5 in a hypotenuse fashion. The scaffolding can, of course, also have a different shape, but it is to include a horizontal bracket with flooring and a beam in parallel to the outside surface of the building.

In this embodiment, two jaws 7 are associated with the scaffolding, namely with beam 5. The jaws 7 are connected mutually independently, respectively with a detachable connection, to the outside face 4 of the building 1. Each jaw 7 has a sleeve 8 accommodating the beam 5, and a traction surface 9 adjoining the outside face. One jaw 7, here the upper one, is fixedly mounted to the beam 5, the other jaw 7, here the lower one, is made to be displaceable with respect to the scaffolding, here with respect to the beam 5. For this purpose, the upper jaw 7 is arranged at the upper end of the beam 5 and secured therebelow with a stop 10 against shifting.

The two jaws 7 are connected to a length-variable element, here with a hydraulic or pneumatic operating cylinder 11. In place of the operating cylinder 11, other solutions could, of course, also be employed, for example a threaded construction.

A forced track 12 guiding the tensioning element through the jaw 7 is fashioned in the jaws 7 between the traction surface 9 and the sleeve 8. The tensioning element in this embodiment is a wire cable 13 guided at the upper jaws 7 as well as at the lower jaws 7 three times around the building 1. As readily derivable from FIG. 2, the forced track 12 is arranged in both upper and lower jaws 7 to be inclined with respect to the traction surface 9, namely in such a way that the upper end of the forced track 12 guiding the wire cable 13 which is closer to the upper part of the building 1 is farther remote from the traction surface 9 and thus, during operation, also from the outside face 4 of the building 1, than the lower end of the forced track 12.

Rollers 14 are furthermore associated with the beam 5 of the scaffolding in parallel with the outside face 4, these rollers being pivotably mounted to the scaffolding in both end zones of the beam 5.

Figure 3:
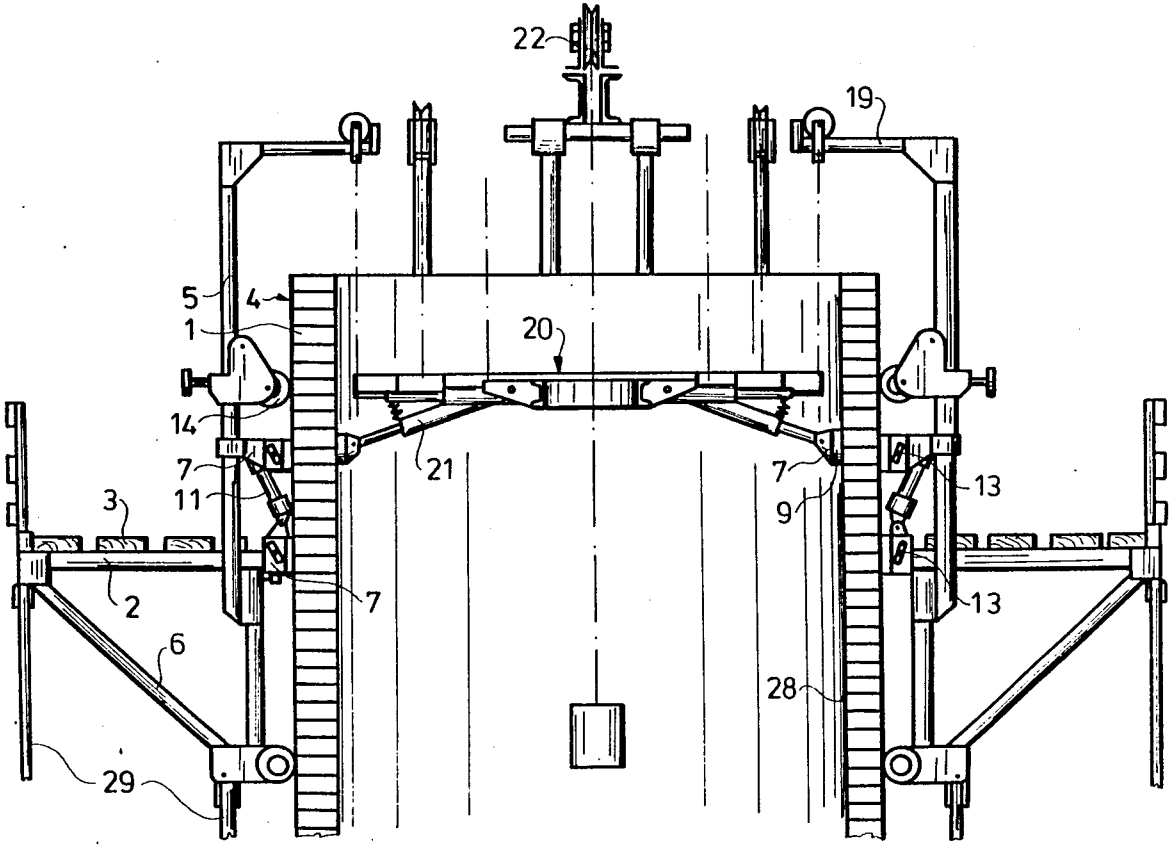
FIG. 3 shows another embodiment in a lateral view, partially in section.

FIG. 3 shows another embodiment of the scaffold of this invention in a schematic cross-sectional view of the building 1. The beam 5 is extended upwardly above the flooring 3. One of the rollers 14 is here also arranged at this extended part of the beam 5, namely in a level-adjustable way. The brackets 2 and 6, the working cylinder 11 between the two jaws 7, and the mutually independent wire cables 13 can also be seen from the drawing. The scaffolding is supplemented by suspension plates 29 where another working platform or other apparatus parts can be suspended.

Figure 4:
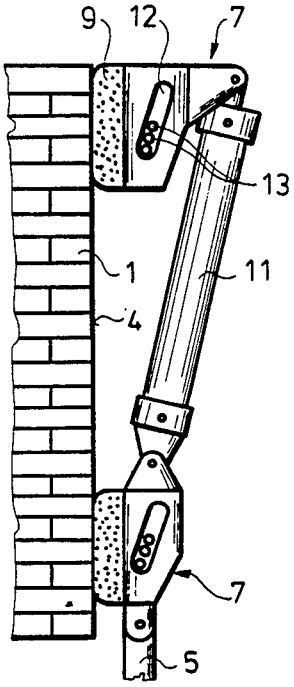
FIG. 4 shows a portion of a further embodiment.

FIG. 4 illustrates two jaws 7 and the working cylinder 11 connecting same in a further embodiment, on an enlarged scale. In this arrangement, both jaws 7 are located above the working platform, and the upwardly prolonged beam 5 of the scaffolding is suspended on the lower jaw 7.

Figure 5:
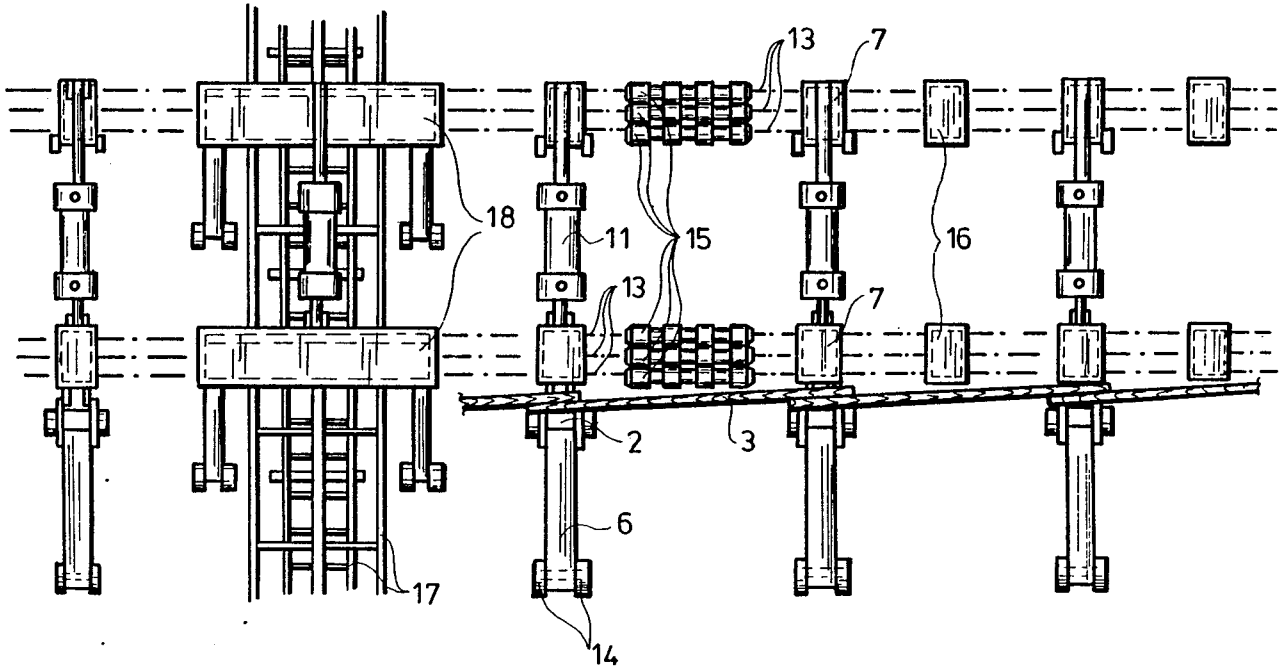
FIG. 5 shows still another embodiment in a rear view.

A similar arrangement is shown in FIG. 5. The scaffolding is suspended below the flooring 3 of the working platform on the lower jaws 7 which are located above the flooring together with the working cylinder 11 and the upper jaws 7.

In this embodiment, respectively three wire cables 13, independent of one another, are utilized with the lower jaws 7 as well as with the upper jaws 7, each of these cables being tightened by respectively one rope tensioning means 15. The figure furthermore shows a ladder at 17 and its safety basket. Such articles arranged on the outside face 4 of the building 1 form an obstacle to the continuance of the wire cable 13 so that they are to be circumvented. A paying-out means designed as a box girder is arranged in the path of the rope for this purpose. The paying-out means 18 of the upper and lower cable paths can be connected in pairs with one working cylinder, and they can also exhibit rollers on the outside face 4 to facilitate movement. The wire cables 13 are interrupted at these paying-out means 18, and the ends of the wire cables 13 are attached to both sides thereof. The paying-out means 18 transmit the load from one side to the other by circumventing the object located on the outside face 4.

Figure 6:
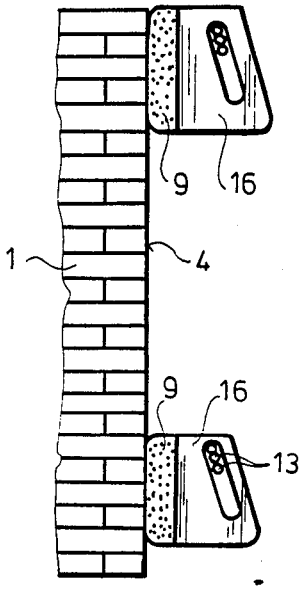
FIG. 6 shows an additional detail: the safety device.

The rope paths likewise include safety jaws 16, likewise urged against the outside face 4 of the building 1 by tensioning elements. These safety jaws 16 serve as an equipment to prevent falls for the entire scaffold. Each safety jaw 16 has a forced track 12 which guides the tensioning element, here constituted by the wire cable 13, and the traction surface 9 in contact with the outside face 4. The forced track 12 here again is arranged to be inclined, but it is designed at the safety jaws 16 so that its upper end, lying closer to the upper portion of the building 1, is closer to the traction surface 9 and thus to the outside face 4 than a lower end of the forced track 12. These details are also shown separately in FIG. 6. The ladder 17, the paying-out means 18, the cable tensioning means 15, and the safety jaws 16 can also be seen in FIG. 1.

The scaffold of this invention operates as follows:

As mentioned above, the two upper and lower jaws 7 of the scaffold are arranged independently of each other at the outer surface 4 of the building by means of a releasable connection. This releasable connection is established by friction, and the normal force (the force perpendicular to the friction surface) is caused by the wire cables 13 serving as tensioning elements. The independent wire cables 13 and therein the rope winches 15 are utilized for making the connection detachable and to render it independent. In the initial position, all rope winches 15 are in the closed condition, and all wire cables 13 are tightened. The scaffold is retained against the building 1 in its position because movement of the scaffold is made impossible by the friction existing between the traction surfaces 9 of the jaws 7 and the outside face 4 of the building 1, since friction prevents the jaws 7 from shifting on the outside face 4 of the building 1.

The generation of the normal force necessary for friction is also enhanced by the design of the forced tracks 12. If, on account of the load exerted on the scaffold, the latter should slip downwardly, the wire cables 13 likewise slide downwardly along the forced track 12 of the jaws 7, passing ever farther away from the outside face 4 to an ever increasing diameter. Consequently, the tensile force in the wire cable 13 and thus the normal force between the traction surface 9 and the outside face 4 becomes ever larger, increasing the friction. The possible slipping of the scaffold is thereby stopped.

For a movement of the embodiment of the scaffold shown in FIG. 2 in the upward direction along the building 1, first the detachable connection at the upper jaws 7 is released by loosening the rope tensioning means 15 of the upper wire cables 13. After separating the jaws 7 from the outside face, the operating cylinders 11 are activated, their pistons extended, their lengths increased. Since the connection between the lower jaws 7 and the outer surface 4 remains preserved, the entire scaffold will move upwards, the rollers 14 supporting the scaffold on the outside face 4. Once the desired height, or the end of the stroke of the working cylinders 11 has been reached, the upper wire cables 13 are again tightened by their rope winches 15, and the connection between the scaffold and the building 1 is reestablished. Thereafter, in a similar way, the lower wire cables 13 are loosened by opening the rope tensioning means 15 and thereby the connection is eliminated at the lower jaws 7. The working cylinders 11 are once again activated, the pistons retracted, the length of the working cylinders shortened, whereby the lower jaws 7 move upwards, but the scaffold as a whole is stationary with respect to the building 1. In the inner end position of the working cylinders 11 or after attaining the desired position, the lower wire cables 13 are again tightened by the rope tensioning means 15, and the connection between the jaws 7 and the outside face 4 is reestablished. If the desired operating level has not as yet been reached, this cycle can be repeated at will. Of course, the procedure can be started with the lower jaws 7 instead of with the upper jaws 7.

The embodiments of FIGS. 3, 4, and 5 function quite similarly, except that the scaffold is moved during the movement of the lower jaws 7, since the scaffold is connected to the lower jaws 7.

As mentioned above, safety measures were taken to preclude any possible dropping of the scaffold of this invention. The safety jaws 16, also arranged at the wire cables 13, exert their effect likewise by friction between their traction surfaces 9 and the outside face 4. In case of a possible downward slipping of the scaffold, the wire cables 13 are likewise forced downwardly, also sliding downwards along the forced track of the safety jaws 16. However, during this step they move ever farther away from the outside face 4, to an ever increasing diameter, the tensile force in the wire cables 13 and thus the normal force between the traction surfaces 9 and the outside face 4 becoming increasingly greater, thus preventing a drop.

Figure 7:
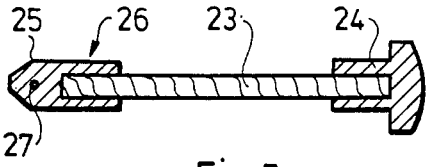
FIG. 7 shows still another detail: a flexible bolt of the working platform.

It is advantageous to connect the floor parts of the floor structure 3 with one another and with the horizontal brackets 2, instead of rigidly, in a way making a certain movement possible. For this purpose, a flexible bolt 26 is suggested shown in a sectional view in FIG. 7. A flexible wire rope 23 is arranged between its end part 25 and head part 24. The bolt 26 is inserted from above in the holes of the floor parts and/or of the brackets 2 and secured against dropping out at the bottom by a bore 27 in the end section 25.

As furthermore shown in FIG. 1, it is possible to provide, besides the outer working platform, also an inner working platform in the interior of the building 1 with the aid of the self-propelled scaffold of this invention. A practical solution for this is shown in FIG. 3 wherein—as mentioned above—the beam 5 is extended upwards above the flooring 3. A jib 19 of a crane system is attached to this extended beam 5. By means of the crane system, the inner working platform 20 is suspended in the interior of the building 1, this platform being likewise equipped with scaffolding and with flooring 3 thereon. The scaffolding has vibration-damping beams to which dropping safety means 21 are connected. The safety means 21 against dropping are articulated to the scaffolding and connected, by jaws 7 equipped with a traction surface 9, to an inside face 28 of the building 1. The dropping safety means 21 themselves are elements likewise suitable for varying their length and are pressed, after positioning the inner working platform 20, at a suitable level in the interior of the building 1, against the inside face 28. If, now, for some reason the connection were to be interrupted between the outer working platform and the inner working platform 20, the drop safety means 21 pressed against the inside face 28 would prevent falling of the inner working platform 20.

One or several of the crane units attached at the beams 5 can be utilized for operating the inner working platform 20.

It has been made possible with the scaffold of this invention to perform the construction and/or servicing operations on high buildings in one operating level all around the building in an uninterrupted fashion, even simultaneously on the outside face and also on the inside face of the building, rather than in vertical strips, in stages. This mode of operation greatly increases the safety as well as the quality of the working steps performed on the buildings.

As can be seen from the above, the rope tensioning means 15 play a decisively significant part in the utilization of the scaffold according to the invention. In order to fulfill the requirements posed in conjunction with the scaffold of this invention, a rope tensioning means has been developed; one embodiment thereof according to the invention is illustrated in FIG. 8 in a schematic sectional view.

The rope winch 15 has two clamping units 101 and 102 and between them a length-variable operating cylinder 103. Each of the clamping units 101 and 102 is equipped with a clamping device 104, to which are connected in this arrangement two working cylinders 105 and 106.

According to the invention, the clamping device 104 is provided with clamping members guided along a conical surface 107. The conical surface 107 is formed in a clamping block 108, also adjoined by the working cylinders 105 and 106 through cylinder covers 109 and 110, respectively. An ear 11 is furthermore attached to the clamping block 108, connecting the cable to be tensioned.

Figure 8:
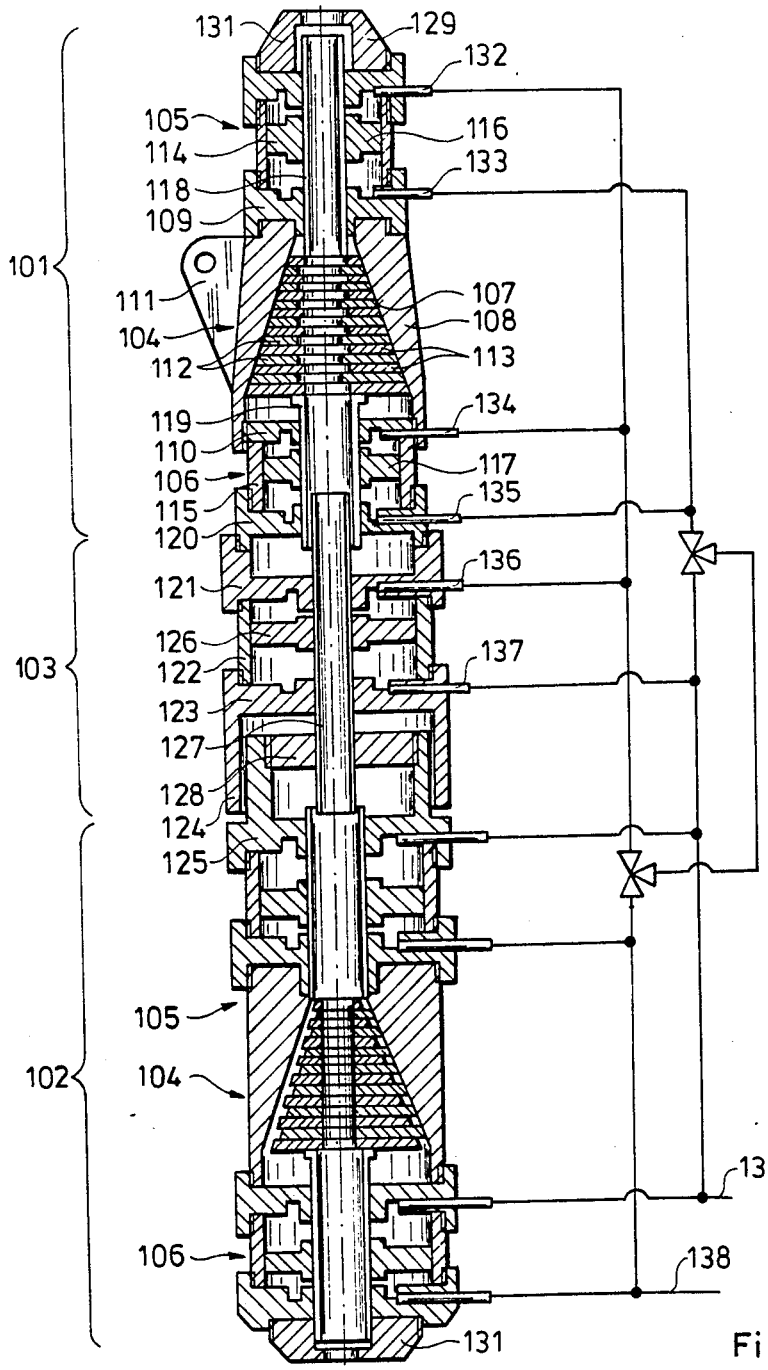
FIG. 8 is a schematic cross section of one embodiment of the rope winch of this invention.

The clamping members, in the embodiment of FIG. 8, are designed as disks 112 and 113, each of which has a circumference adapted to the conical surface 107 and a bore, the diameter of the bores being at least no smaller than the diameter of the cable to be tensioned. In case of the disks 112, the bores are fashioned to be eccentric with respect to the center of the disks 112 or, with the disks 112 installed, with respect to the central axis of the rope tensioning means. This eccentricity is the same in all disks 112. In contrast thereto, the bores in the disks 113 are arranged to be concentric with respect to their centers as well as to the central axis. As can be seen from the figure, the clamping devices 104 are assembled so that each disk 112 with an eccentric bore is juxtaposed beside a disk 113 with a concentric bore, i.e. the disks 112 and the disks 113 are arranged in alternating series.

The two disks 112 and 113 can, of course, be made with a differing eccentricity of the bores. They need not be arranged in alternating sequence, either. However, under practical conditions, the above-described arrangement proved to be the best.

The operating cylinders 105 and 106, respectively, comprise a cylinder 114 and 115, connected to the cylinder cover 109 and 110, and therein respectively one piston 116 and 117. The pistons 116, 117 are each attached to a piston rod 118 and 119 of tubular configuration. Their inner diameters are at least as large as the outer diameter of the rope to be tensioned.

The working cylinder 103, moving the two clamping units 1 and 2 with respect to each other, is connected to the working cylinder 106 of the clamping unit 101, as well as to the working cylinder 105 of the clamping unit 102. The other cylinder cover 120 of the working cylinder 106 is attached to the cylinder cover 121 of the working cylinder 103. A cylinder 122 and thereafter a further cylinder cover 123 are connected to the cylinder cover 121. This cylinder cover 123 has a lengthened skirt portion 124 receiving in a telescope like fashion the upper cylinder cover 125 of the working cylinder 105, which upper cylinder cover 125 has likewise been lengthened for this purpose.

The piston 126 of the working cylinder 103 is arranged in the cylinder 122, the piston rod 127 being likewise tubular. The cylinder cover 125 of the working cylinder 105 of the clamping unit 102 is connected to the piston rod 127, in this embodiment by means of an insert 128. The piston rod 127 is furthermore designed so that it extends into the tubular piston rod 119 of the working cylinder 106 of the clamping unit 101 and, respectively, into the piston rod 118 of the working cylinder 105 of the clamping unit 102. The piston rod 127 has such a length that it can never leave the piston rods 118, 119. These piston rods 118, 119, and 127 thus are joined in the manner of a telescope; the piston rod 127 can slide within the piston rods 118 and 119.

The working cylinder 105 of the clamping unit 101, as well as the working cylinder 106 of the clamping unit 102 are furthermore sealed off on the outside with respectively one cylinder cover 129, 130, provided at both ends of the rope tensioning means with respectively one guide piece.

The working cylinders 103, 105, and 106 are furthermore equipped with pipe connections 132 and 133, 134 and 135, as well as 136 and 137, which feed and discharge the pressure medium required for the alternating movement of their pistons 116, 117, and 126. One of the two pipe connections of each working cylinder is connected with one branch, the other pipe connection with another branch, of a conduit 138 pertaining to a pressure medium source, not shown. In the condition illustrated in FIG. 8, the pipe connections 133, 135, and 137 are under pressure, the others are in communication with the atmosphere. By means of the connection of the two branches shown in the figure, the two clamping units 101 and 102 can be closed whereby a secure retention of the cable is made possible.

The clamping units 101 and 102 work as follows: The working cylinder 105, arranged on one side of the clamping device, has the task of opening the clamping device 104, and the other working cylinder 106 is to close same. In FIG. 8, the clamping device 104 of the clamping unit 101 is in the closed condition, i.e. the piston rod 119 of the working cylinder 106 exerts its action on the disk 113 having the largest diameter. Consequently, the disks 112 and 113 are shifted along the conical surface 107, the disks 112, provided with eccentric bores, pressing into the cable to be tensioned. In this condition, the pressure medium is applied to the pipe connection 135 of the working cylinder 106 and to the pipe connection 133 of the working cylinder 105. The clamping device 104 of the clamping unit 102 is in the open condition.

In order to open the clamping device 104 of the clamping unit 101, an action is exerted by means of the working cylinder 105 on the uppermost disk 113 by disconnecting pressure from the pipe connections 133 and 135 and applying same to the pipe connections 132 and 134. As a consequence, the pistons 116 and 117 of the working cylinders 105 and 106 move downwards in the figure, together with the disks 112 and 113, the periphery of which comes in contact with an ever increasing diameter of the conical surface 107. The disks 112 with eccentric bores leave the cable so that the latter can be moved freely at the clamping device 104. This condition is illustrated in connection with the clamping device 104 of the clamping unit 102.

During operation of the rope tensioning means 15, the clamping units 101 and 102 are closed and opened, respectively, in phase opposition. Thus, while the clamping unit 101 retains the cable during operation, the clamping unit 102 allows the cable to move freely. During this step, the two clamping units 101 and 102 are moved with respect to each other by the working cylinder 103. Thereby a tensioning motion of the rope winch is produced.

The embodiment of FIG. 8 shows the solution wherein, when the clamping unit 101 is in the closed condition, the pressure medium is conducted through the pipe connection 137 in the figure underneath the piston 126, whereupon the cylinder cover 123 is pulled, by the piston rod 127, underneath the extended skirt portion 124 of the cylinder cover 123. However, during this step the clamping unit 102 is in the open condition since pressure has been conducted above the piston of the working cylinder 105 of the clamping unit 102. Therefore, the cable can move freely at the clamping unit 102.

In the next phase, the clamping unit 101 is opened and simultaneously the clamping unit 102 is closed and the piston 126 of the working cylinder 103 is moved downwards. The entire rope tensioning means becomes longer, the cylinder cover 126 slides out from underneath the skirt portion 124. With repetition of this process, the tensioning motion is produced whereby the cable connected to the ear 111 of the clamping block 108 of clamping unit 101 is pulled taut, is tensioned.

FIG. 9 shows a different embodiment of the rope tensioning means of this invention. In this arrangement, the clamping units 101 and 102, as well as the working cylinder 103 therebetween are likewise illustrated. However, clamping jaws 141 are provided in the clamping devices 104 of clamping units 101, 102, in place of the disks 112 and 113; these jaws, as in a collet, are likewise guided along the conical surface 107 of the clamping block 108, in this case also in a linear fashion, secured against rotation. As seen in a sectional view, the three clamping jaws 141 utilized in this embodiment are arranged at 120° spacings with respect to each other in the clamping block 108.

The conical surface 107, linearly guiding the clamping jaws 141, can be made up of cylindrical partial surfaces inclined with respect to the longitudinal axis of the rope winch; the outer peripheral surfaces of the clamping jaws 141 in contact with these partial surfaces are likewise cylindrical. The inner clamping faces of the clamping jaws 141 can be fluted. Of course, other designs for the clamping jaws 141 are likewise possible.

In this case, only respectively one working cylinder 142 is connected to the clamping units 101 and 102, this cylinder alone performing the opening and closing of the clamping devices 104. A cylinder cover 143 of the working cylinder 142 is connected to the clamping block 108, its other cylinder cover 144 is connected to a cylinder cover 145, seen at the top of the figure, pertaining to the working cylinder 103. The cylinder 146 of the working cylinder 142 is attached between the cylinder covers 143 and 144, a piston 147 and a piston rod 148 attached thereto being movably arranged in this cylinder 146. The clamping jaws 141 of the clamping device 104 are associated with the piston rod 148, namely in a way transmitting the compressive force as well as the tensile force by means of a locking member 149.

A cylinder 150 joined to a cylinder cover 151 is connected to a cylinder cover 145 of the working cylinder 103. The clamping block 108 of the clamping device 104 of the clamping unit 102 is equipped with an extension 152 projecting in the manner of a telescope 151 into an extended skirt section 154 of the cylinder cover. Also the piston 153 of the working cylinder 103 has a tubular piston rod 155 which, on the one hand, extends in telescope fashion into the piston rod 148 of the working cylinder 142; on the other hand, it is attached to the extension 152 coupled with the clamping block 108 of the clamping device 104 pertaining to the clamping unit 102.

The working cylinders 103, 142 have pipe connections 156 and 157, 158 and 159, for the feeding and discharging of the pressure medium.

In order to operate the clamping units 101, 102, only one working cylinder 142 is required—as mentioned above. For closing the clamping device 104, the clamping jaws 141 must be moved upwards as seen in the figure with the aid of compressive force transmitted from the piston 147 or the piston rod 148 via the locking member 149; the clamping jaws 141, sliding along the conical surface 107, pass to an ever decreasing diameter, thus closing and pressing on the cable. For this purpose, the pressure medium is conducted through the pipe connection 156 into the working cylinder 142.

In order to open the clamping device 104, pressure is disconnected from the pipe connection 157, and the pressure medium is conducted through the pipe connection 156 above the piston 147 which latter will then move downwardly. By the tensile force exerted by the piston rod 148 and/or by the locking member 149, the clamping jaws 149 will be pulled downwards, passing along the conical surface 107 on an ever increasing diameter, thus releasing the cable.

The rope tensioning means 15 proper functions, in this embodiment, as described in conjunction with FIG. 8. The clamping units 101, 102, opened and/or closed in phase opposition, are moved with respect to each other by the pressure medium conducted below and above the piston 153 of the working cylinder 103, respectively; the extension 152 and thereby the clamping unit 102 are pulled underneath and, respectively, urged out from under the skirt portion 154 of the cylinder cover 151 by means of the piston rod 155.

As can be seen from the above, the rope tensioning means of this invention is built as a compact unit in both embodiments. The pressure medium can be either a hydraulic fluid or compressed air, or even both. In the former case, hydraulic working cylinders are to be used, in the second case, pneumatic working cylinders. The supply of such working cylinders with pressure media and the logic circuits required for the activation thereof are part of modern knowledge and do not present a problem to persons skilled in the art. Therefore, a more detailed description of these factors is unnecessary herein.

The embodiment of FIG. 1 can be operated in an especially advantageous fashion with ropes made of a synthetic resin. Such plastic cables are utilized in water or in an aggressive environment. The embodiment of FIG. 2 proved to be especially advantageous for wire cables since the clamping jaws 141 do not damage the wire cable. This arrangement is preferred for routine tasks on account of its simple structure.

I claim:

1. In a self-propelled scaffold for buildings exhibiting a continuous outline, wherein the scaffold comprises a framework having a vertical beam, a working platform formed on a horizontal bracket of the framework and tensionable elements extended around the building and providing a detachable connection between the building and the framework; the improvement in which, at each of at least two levels of height, the framework is associated with at least one set of jaws, through which the tensionable elements are passed for holding them away from an outer surface of the building and each set of jaws is connected respectively with a mutually independent, detachable connection to the outer surface of the building, one set of said jaws being fixedly attached to the to said beam and another set of said jaws having a sleeve which slidingly accomodates the beam and being joined to said one set of jaws by a length-variable element.

2. Scaffold according to claim 1, in which at least two sets of said jaws are associated with a beam of the framework parallel to the outside face of the building and one jaw set is attached to the beam and another jaw set is arranged thereon in a displaceable fashion.

3. Scaffold according to claim 1, in which the detachable connection between the jaw sets and the outside face of the building is produced by friction, the normal force necessary for friction being generated by tensionable elements passing through the jaws and pressing them against the outer surface of the building.

4. Scaffold according to claim 1, in which the length-variable element is fashioned as a fluid pressure cylinder (11).

5. Scaffold according to claim 1, in which at least two rollers (14) are associated with the beam (5) in parallel with the outside face (4) of the building (1).

6. Scaffold according to claim 1, in which the tensioning element is fashioned as a chain.

7. Scaffold according to claim 1, characterized in that the tensioning element is fashioned as a wire cable (13).

8. Scaffold according to claim 1, in which each jaw set (7) is equipped with a sleeve (8) accommodating the beam (5) of the framework, a forced track (12) through which passes the tensioning element, and a traction surface (9) in contact with the outside face (4) of the building (1).

9. Scaffold according to claim 8, in which the forced track (12) is arranged to be inclined with respect to the traction surface (9), the upper end of the forced track (12) lying closer to the upper portion of the building (1) being farther remote from the traction surface (9) than the lower end.

10. Scaffold according to claim 1, equipped with a device to prevent falling, comprising safety jaws (16) pressed against the outside face (4) of the building (1) by at least two mutually independent tensioning elements.

11. Scaffold according to claim 10, in which each safety jaw set (16) comprises a forced track (12) through which passes the tensioning element, and a traction surface (9) in contact with the outside face (4).

12. Scaffold according to claim 11, in which the forced track (12) is arranged to be inclined with respect to the traction surface (9), the upper end of the forced track (12) lying closer to the upper portion of the building (1) being closerto the traction surface (9) than the upper end.

13. Scaffold according to claim 1, and a jib (19) of a crane unit is connected to the beam (5) of the framework in parallel to the outside face (4), and an inner working platform (20) is suspended in the interior of the buidling (1) by means of the crane unit.

14. Scaffold according to claim 13, in which the inner working platform (20) comprises a scaffolding and the latter comprises flooring (3), vibration-damping beams, and means preventing falling (21), wherein the means preventing falling (21) are articulated to the scaffolding and connected to an inside face (28) of the building (1) by jaws (7), each provided with a traction surface (9).

15. Scaffold according to claim 14, in which the inner working platform (20) is serviced by the crane unit.

16. Scaffold according to claim 1, characterized in that the variable tensioning element is associated with at least one tensioning means connected thereto.

17. Scaffold according to claim 16, characterized in that the tensioning means is fashioned as a fluid pressure rope winch (15).

* * * * *